US005961310A

United States Patent [19]

McClure

[11] Patent Number: 5,961,310

[45] Date of Patent: Oct. 5, 1999

[54] EXTERNAL COMBUSTION ROTARY ENGINE

[76] Inventor: Troy A. McClure, 1601 W. J St., Oakdale, Calif. 95361

[21] Appl. No.: 08/900,727

[22] Filed: Jul. 25, 1997

[51] Int. Cl.[6] ..... F01C 1/46

[52] U.S. Cl. ..... 418/248

[58] Field of Search ..... 418/152, 248, 418/249

[56] References Cited

U.S. PATENT DOCUMENTS

| | | | |
|---|---|---|---|
| 165,772 | 7/1875 | Weyhe | 418/248 |
| 579,851 | 3/1897 | Verret et al. | 418/249 |
| 684,471 | 10/1901 | Stevens | 418/249 |
| 714,425 | 11/1902 | Williams | 418/248 |
| 756,904 | 4/1904 | Stephan | 418/248 |
| 791,695 | 6/1905 | Hudson et al. | 418/248 |
| 845,270 | 2/1907 | Schmidt | 418/248 |
| 855,028 | 5/1907 | Walker | 418/249 |
| 934,830 | 9/1909 | Paine | 418/248 |
| 974,803 | 11/1910 | Lukacsevics | 418/248 |
| 3,801,241 | 4/1974 | Martin et al. | 418/152 |
| 4,076,471 | 2/1978 | McClure | 418/143 |

*Primary Examiner*—John J. Vrablik
*Attorney, Agent, or Firm*—Jack Lo

[57] ABSTRACT

An external combustion rotary engine includes a piston arranged to travel around a toroidal chamber in an engine block. Intake and exhaust ports extend into the chamber at radially separated positions. A gate hinged at a top edge extend across the chamber between the intake and exhaust ports. A driveshaft is aligned with the center of the toroidal chamber, and a tubular cam is coaxially and slidably positioned on the driveshaft within the engine block. The cam includes a protruding cam surface with a spiral leading edge. The piston is attached to the edge of a disc concentric with and attached to the driveshaft. The cam is slidable along the driveshaft for advancing or retracting the spiral leading edge from an intake valve for varying the timing thereof. When the valve is opened, the piston is pushed around the chamber by a pressurized gas introduced through the intake port. Exhaust gas is pushed ahead of the piston through the exhaust port. The gate is opened when struck by the piston. After the piston has traveled past the gate, the gate is closed, and the cycle is repeated.

2 Claims, 4 Drawing Sheets

EXTERNAL COMBUSTION ROTARY ENGINE

CROSS REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention:

This invention relates generally to rotary engines.

2. Prior Art:

An external combustion rotary engine is disclosed in my U.S. Pat. No. 4,076,471. It includes a plurality of pistons each traveling around a toroidal chamber. Each piston is attached to the edge of a disc concentric with the center of the chamber. The disc is attached around a driveshaft. A normally-closed gate with two spring-loaded pivoting members is arranged within each chamber. An intake port is positioned on one side of the gate, and an exhaust port is positioned on the other side of the gate. The gate is arranged for opening only in the direction of the intake port. An intake valve is controlled by an overhead cam arranged on a camshaft, which is driven by a belt connected to the driveshaft. A pressurized gas produced by external combustion, such as steam, is directed into the chamber through the intake port. The piston is driven around the chamber by the gas pushing against it, and the driveshaft is caused to rotate by the disc fixedly connected between the piston and the driveshaft. Gas on the front side of the piston is pushed out the exhaust port. The gate is opened when struck by the piston. After the piston has traveled past the gate, the gate is closed, and the cycle is repeated.

OBJECTS OF THE INVENTION

An object of the present invention is to provide an improved external combustion rotary engine.

Another object of the present invention is to provide a rotary engine with simpler gates that also provide an improved seal.

Another object of the present invention is to provide a rotary engine with pistons that provide an improved seal.

Another object of the present invention is to provide a rotary engine with an internal cam for simplicity and compactness.

Another object of the present invention is to provide a rotary engine with a cam arranged for providing throttle control.

Another object of the present invention is to provide a rotary engine that provides the longest heatstroke possible.

Yet another object of the present invention is to provide a rotary engine that converts the kinetic energy of a gas into rotary motion with maximum efficiency.

Further objects of the present invention will become apparent from a consideration of the drawings and ensuing description.

BRIEF SUMMARY OF THE INVENTION

An external combustion rotary engine comprises a plurality of pistons each arranged to travel around a separate toroidal chamber in an engine block. Intake and exhaust ports communicate with the chamber at radially separated positions. A normally-closed gate hinged at a top edge extend across the chamber between the intake and exhaust ports. A driveshaft is aligned with the center of the toroidal chamber, and a cam is coaxially and slidably positioned on the driveshaft within the engine block. The piston is attached to the edge of a disc concentric with and attached to the driveshaft. The cam includes a protruding cam surface with a spiral leading edge. The cam is slidable along the driveshaft for advancing or retracting the spiral leading edge from the stem of an intake valve for varying the timing thereof. When the valve is opened, the piston is pushed around the chamber by a pressurized gas introduced through the intake port. Exhaust gas is pushed ahead of the piston through the exhaust port. The gate is opened when struck by the piston. After the piston has traveled past the gate, the gate is closed, and the cycle is repeated.

DETAILED DESCRIPTION OF THE INVENTION

Figure 1:
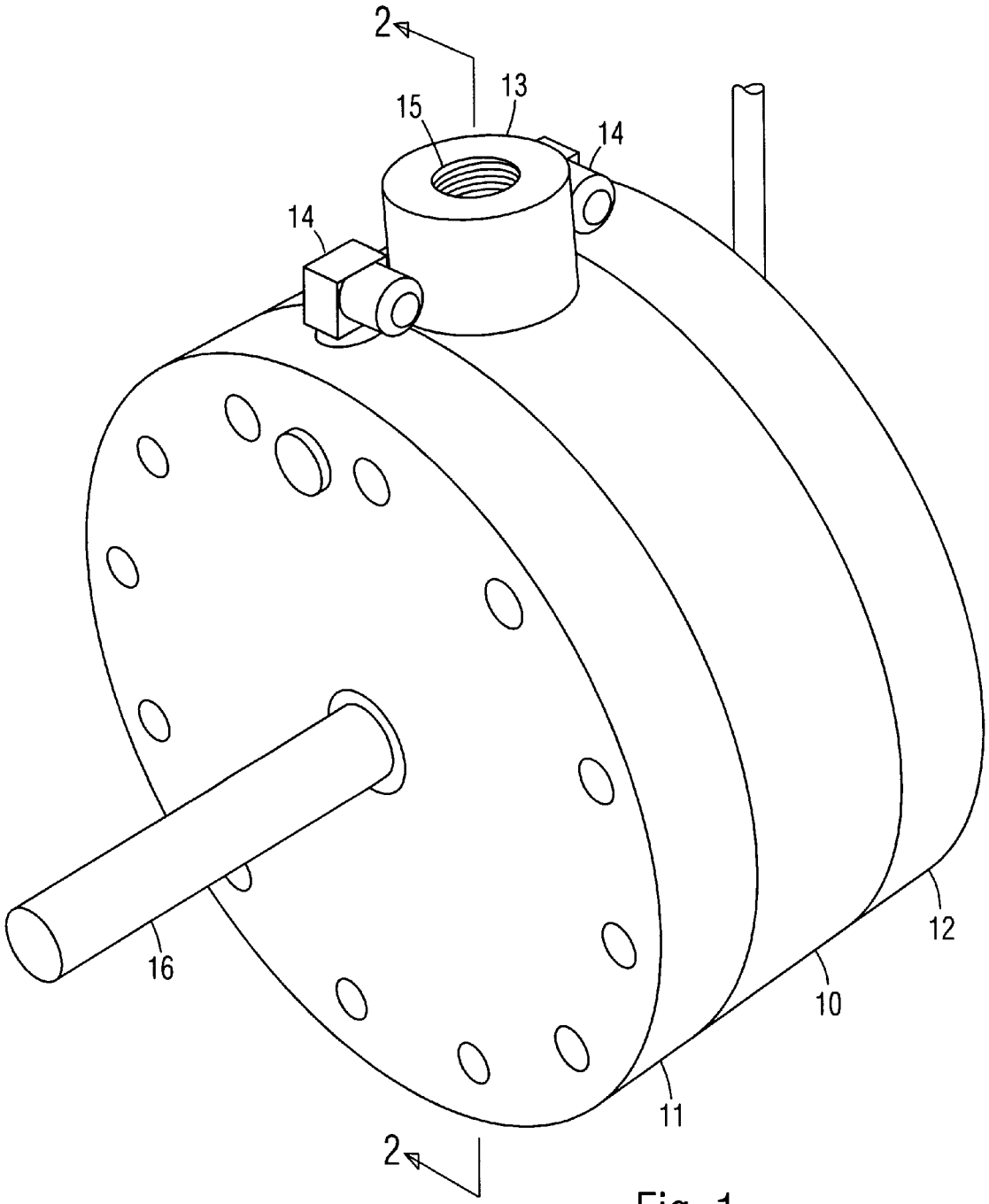
FIG. 1 is a side perspective view of an external combustion rotary engine in accordance with the invention.

FIGS. 1-2:

In accordance with a preferred embodiment of the invention shown in the side perspective view of FIG. 1, an external combustion rotary engine includes an engine block with a mid block 10 bolted between end blocks 11 and 12. An intake plenum 13 with a threaded hole 15 is attached to the top of mid block 10, and exhaust connectors 14 are attached to the top of end blocks 11 and 12. A driveshaft 16 extends from end block 11.

Figure 2:
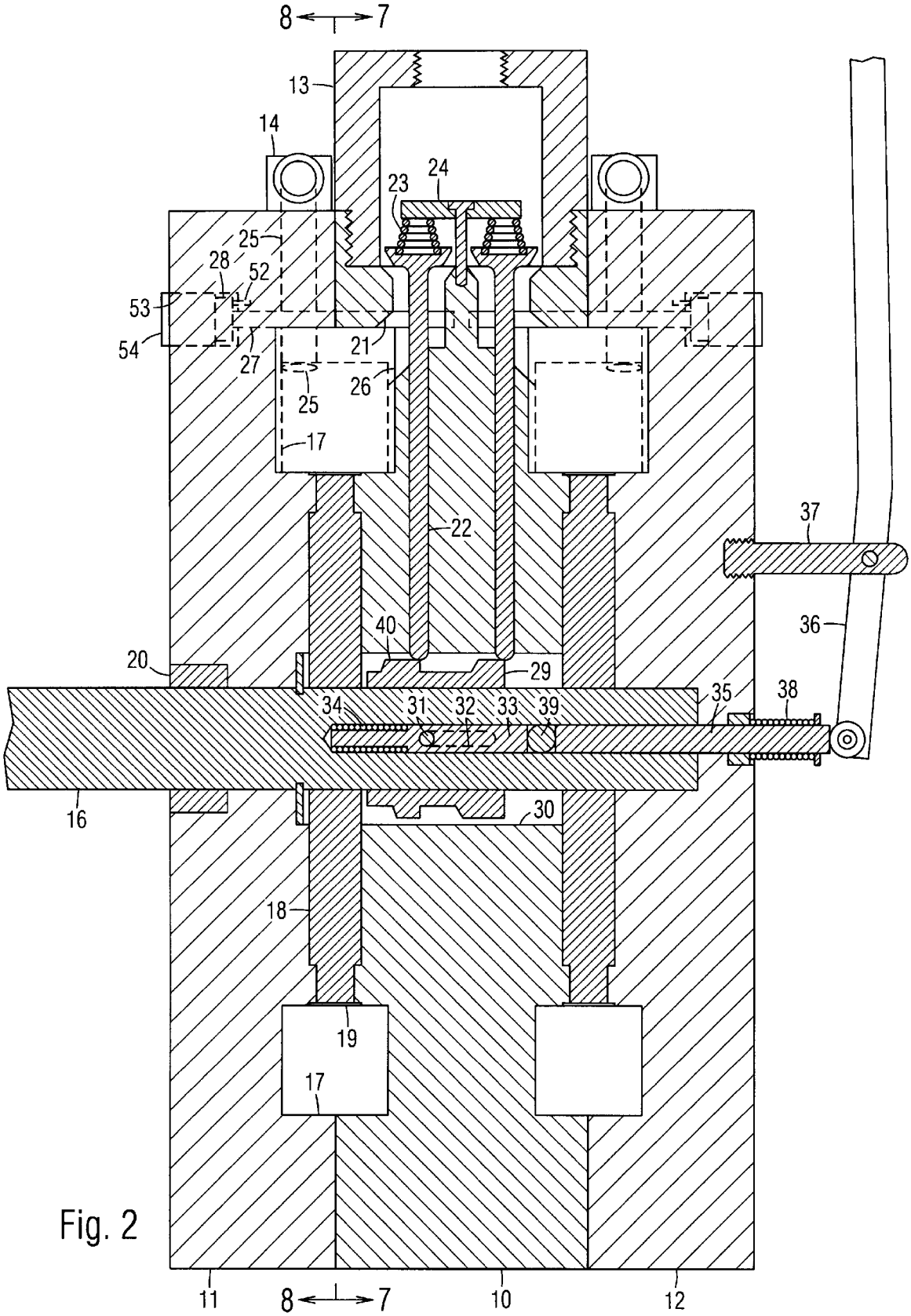
FIG. 2 is a side sectional view of the engine, taken along line 2—2 in FIG. 1.

The engine is shown in a sectional view in FIG. 2. A pair of toroidal chambers 17 are arranged between end block 11 and mid block 10, and between end block 12 and mid block 10. The center of each chamber 17 is aligned with driveshaft 16. A pair discs 18 are positioned between end block 11 and mid block 10, and between end block 12 and mid block 10. Each disc 18 has a diameter equal to the inside diameter of chamber 17. Disc 18 is fixedly and concentrically attached to driveshaft 16 for simultaneous rotation. A sealing ring 19 is attached to the edge of disc 18 for providing a gas seal between chamber 17 and disc 18. An annular seal 20 is arranged around driveshaft 16 on the side of end block 11.

An intake port 21 extends between chamber 17 and intake plenum 13 on mid block 10. The top of an intake valve 22 is positioned over the top of intake port 21. Valve 22 is biased downwardly by a spring 23 positioned between its top and a bracket 24 attached to mid block 10. An exhaust port 25 extends between chamber 17 and exhaust connector 14 on end blocks 11 and 12. Intake port 21 and exhaust port 25 are radially offset along the periphery of chamber 17. A normally-closed gate 26 extends across chamber 17 to form a barrier between intake port 21 and exhaust port 25. Gate 26 is slightly wider and taller than most of chamber 17, which includes a slightly wider portion for receiving gate 26. Gate 26 is hinged at its top edge about a pivot 27, which is loaded by a coil spring 28 for biasing downwardly against disc 18. Coil spring 28 is concentric about the axis of pivot 27. Coil spring 28 has an inner end attached to pivot 27, and an outer end anchored by a pin 52. Coil spring 28 is retained in a hole 53 by a plug 54.

A tubular cam 29 is positioned in a cam chamber 30 in mid block 10, and is coaxially positioned around driveshaft 16. Cam 29 is rotationally locked to driveshaft 16 for simultaneous rotation by a pin 31 extending through a hole (FIG. 5) in cam 29, a slot 32 in driveshaft 16, and a hole in a rod 33 coaxially positioned within driveshaft 16. Cam 29 and rod 33 are thus connected by pin 31 for simultaneous sliding movement along driveshaft 16. Slot 32 in driveshaft 16 enables pin 31 to slide with cam 29. Rod 33 is biased toward end block 12 by a spring 34, so that cam 29 is also biased in the same direction. A coaxial plunger 35 can be moved in or out of driveshaft 16 by a throttle lever 36 connected thereto and pivoted about a post 37 attached to end block 12. Plunger 35 is biased outwardly by a spring 38. A connection between rotating rod 33 and non-rotating plunger 35 is provided by a ball 39 positioned therebetween. Cam 29 includes protruding cam surfaces 40 engaging the stems of intake valves 22. Cam 29 is completely internal of the engine block, and is driven directly by driveshaft 16 without a belt, so that the engine is simpler and more compact.

When the top of throttle lever 36 is pivoted away from the engine block, plunger 35 is moved inwardly, cam 29 is moved toward end block 11, and the stems of intake valves 22 are caused to ride up to the top of cam surfaces 40, as shown in FIG. 2, so that intake valves 22 are opened. When the top of throttle lever 36 is pivoted toward the engine block, plunger 35 is moved outwardly, cam 29 is moved toward end block 12, and cam surfaces 40 are disengaged from the stems of intake valves 22, so that intake valves 22 are closed. Throttle control is thus provided by moving lever 36.

Figure 3:
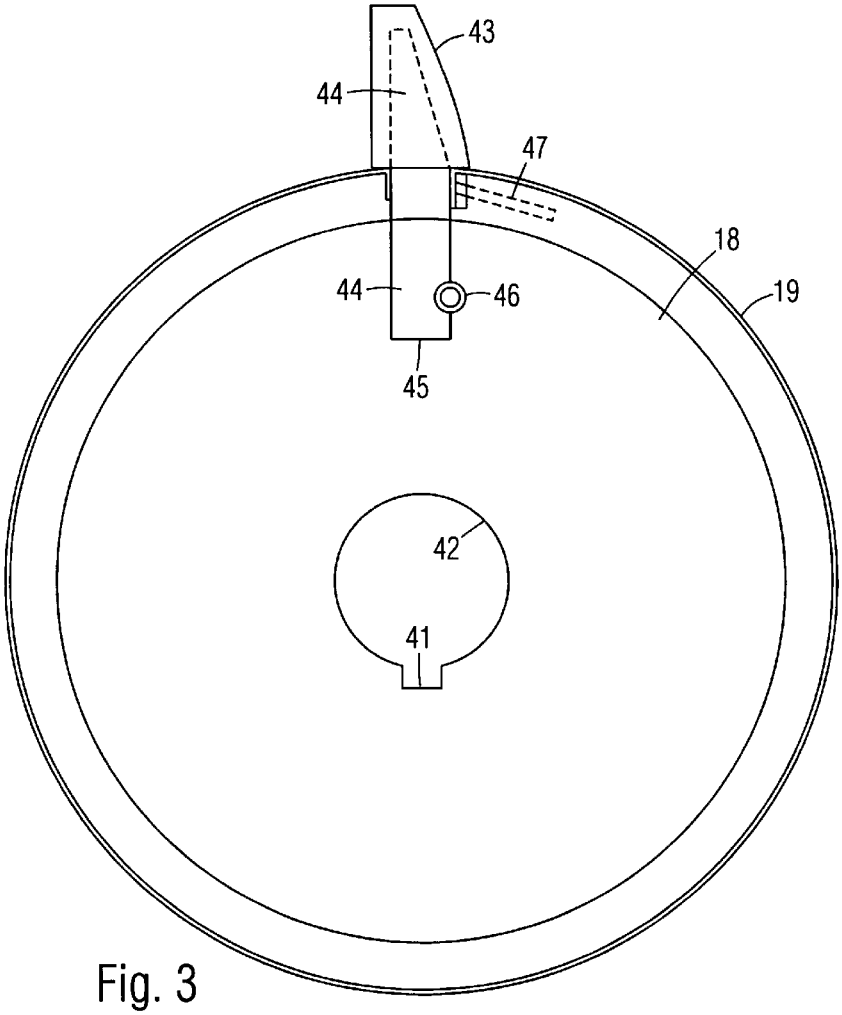
FIG. 3 is a side view of a piston and a disc of the engine.
Figure 4:
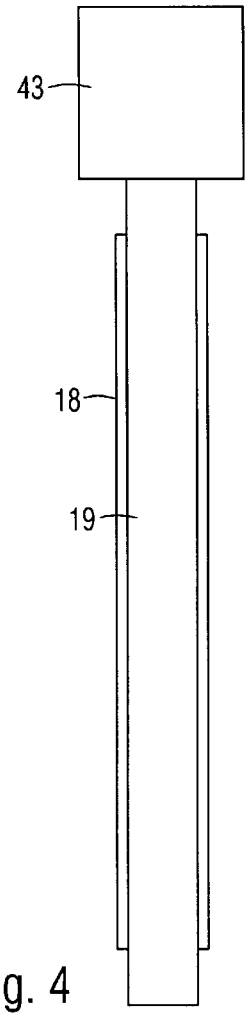
FIG. 4 is an edge-on view of the piston and the disc.

FIGS. 3-4:

One of discs 18 is shown in a side view in FIG. 3 and an edge-on view in FIG. 4. A key notch 41 on a driveshaft mounting hole 42 is provided for mating with a corresponding key tab (not shown) on driveshaft 16 (FIG. 2). A piston 43 made of polytetrafluoroethylene, sold under the trademark TEFLON, is attached to the edge of disc 18. In the view shown, piston 43 is arranged for clockwise rotation. Piston 43 includes a front side which is slanted backwardly, and which includes a slightly convex contour. A metal support 44 extends between a hollow interior of piston 43 and a matching notch 45 extending into the edge of disc 18. Support 44 is locked in notch 45 by a key 46. The ends of sealing ring 19 are bent inwardly against the front and back sides of support 44. A spring loaded tensioning member 47 extending from a hole in disc 18 engages one end of ring 19 to tighten it against the edge of disc 18.

Figure 5:
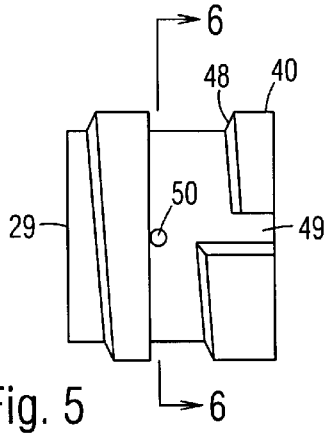
FIG. 5 is a side view of a cam of the engine.
Figure 6:
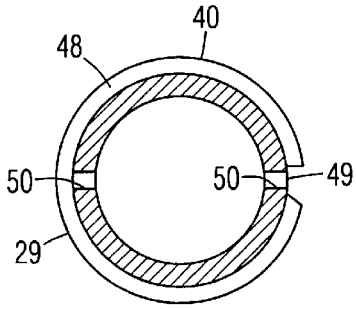
FIG. 6 is an end sectional view of the cam taken along line 6—6 in FIG. 5.

FIGS. 5-6:

Cam 29 is shown in a side view in FIG. 5 and in an end sectional view in FIG. 6. Cam 29 includes protruding cam surfaces 40 which are offset by 180 degrees. Each cam surface 40 includes a spiral leading edge 48 and a notch 49. The lift for intake valves 22 (FIG. 2) is determined by spiral leading edge 48. If cam 29 is fully advanced, such as the position shown in FIG. 2, the valves are lifted or opened for almost the entire revolution of cam 29, except for a few degrees when notch 49 is passed under the valves. The few degrees of closing is timed to coincide with the passage of piston 43 (FIG. 3) through gate 26 (FIG. 2), when gate 26 is opened. If cam 29 is partially advanced, spiral leading edge 48 will disengage from the intake valve for a greater number of degrees or portion of the cam's revolution, so that the intake valve will be closed for a longer time. Thus variable valve timing and throttle control are provided by controlling the advance of spiral leading edge 48 relative to the intake valve. Holes 50 are for passing pin 31 (FIG. 2).

Figure 7:
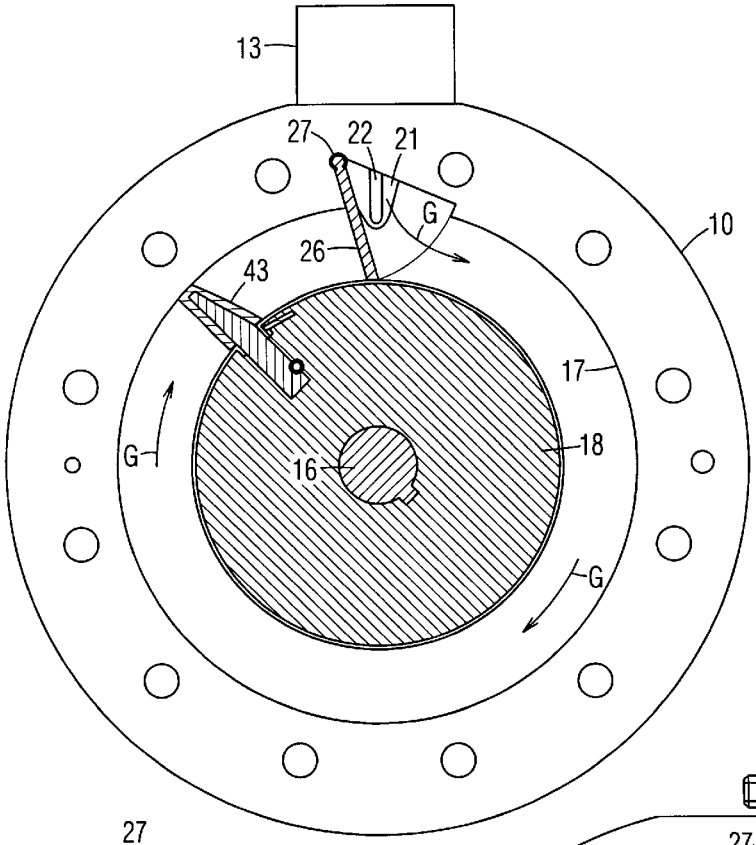
FIG. 7 is an end sectional view of the engine, taken along line 7—7 in FIG. 2.

FIGS. 7-8:

Mid block 10 is shown in an end sectional view in FIG. 7. A pressurized gas G is fed into chamber 17 through intake port 21. Gas G may be any suitable pressurized gas, such as steam, an aerosol propellant, compressed air, etc. Piston 43 is pushed around chamber 17 by the force of gas G against the back side thereof. Piston 43 forms a lever or moment arm of a fixed length relative to the center of driveshaft 16, so that the kinetic energy of gas G is converted into rotary motion with maximum efficiency. At full throttle, intake valve 22 is opened for almost the entire revolution of piston 43 so as to provide the longest possible heat stroke. Being made of polytetrafluoroethylene, piston 43 slides around chamber 17 with minimal friction, while it provides an improved seal. Gate 26, which is arranged for opening only in the direction of gas flow or piston rotation, is kept closed against the edge of disc 18 by spring and gas pressure. Gate 26 is simpler and provides an improved seal.

Figure 8:
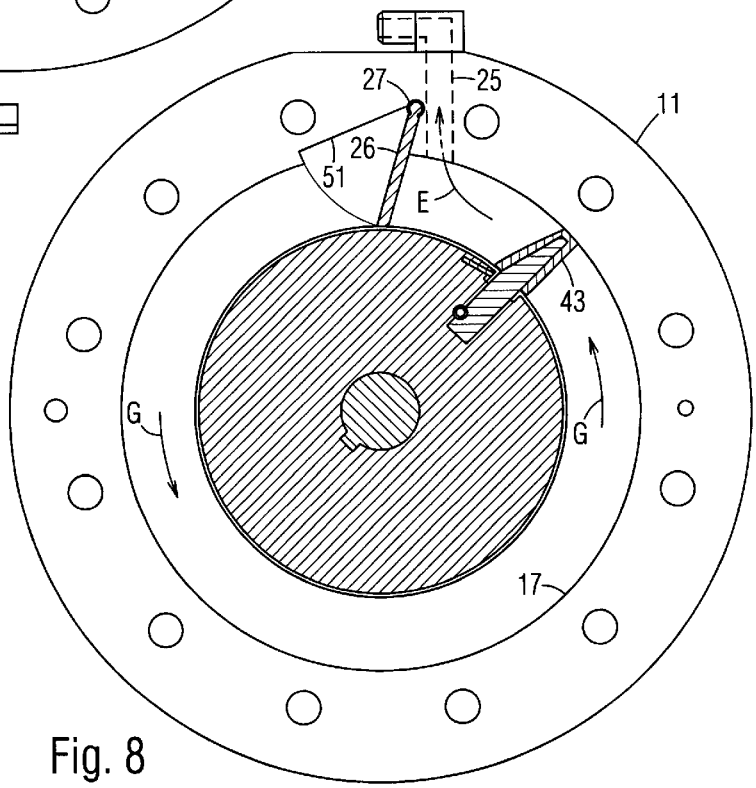
FIG. 8 is an end sectional view of the engine, taken along line 8—8 in FIG. 2.

End block 11 is shown in an end sectional view in FIG. 8. Piston 43 is shown in the same position as it is in FIG. 7. Exhaust gas E is pushed out exhaust port 25 by the front side of piston 43. Gate 26 is pivoted upwardly against a recess 51 when struck by piston 43. Shock to gate 26 is minimized by the convex front side of piston 43. During the brief time when gate 26 is opened, intake valve 22 (FIG. 2) is closed, even during full throttle. When piston 43 is past, gate 26 is biased to the closed position by spring pressure, and the intake valve is opened again to begin another cycle. The other disc and piston are offset by 180 degrees for balance.

Figure 9:
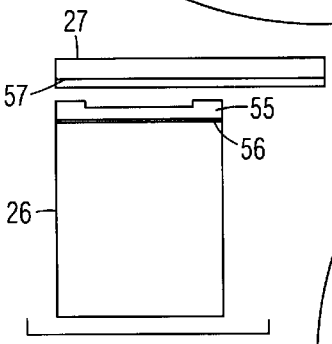
FIG. 9 is an exploded side view of a gate and its pivot.
Figure 10:
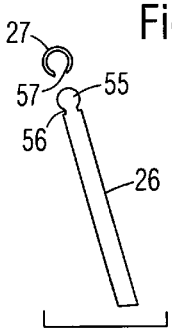
FIG. 10 is an exploded end view of the gate and pivot.

FIGS. 9-10:

Gate 26 and its pivot 27 are shown in an exploded side view in FIG. 9 and an end view in FIG. 10. Gate 26 includes a cylindrical head 55 and a constricted neck 56 for sliding into a slot 57 of tubular pivot 27.

SUMMARY AND SCOPE

Accordingly, I have provided an improved external combustion rotary engine. It includes simpler gates that provide an improved seal. It includes pistons that also provide an improved seal. It includes compact internal cams for actuating intake valves, and the cams are arranged for providing throttle control. It provides the longest possible heatstroke, and it converts the kinetic energy of a gas into rotary motion with maximum efficiency.

Although the above descriptions are specific, they should not be considered as limitations on the scope of the invention, but only as examples of the embodiments. Many substitutes and variations are possible within the teachings of the invention. For example, instead of rectangular, the cross section of toroidal chamber 17 may be of other shapes, such as square or circular. More or fewer chambers may be provided. Plunger 35 and ball 39 may be eliminated, and rod 33 may be extended to engage lever 36; the tip of rod 33 may engage lever 36 without being attached thereto, so that rod 33 is free to rotate against lever 36. Rod 33, ball 39, and plunger 35 may be eliminated, and cam 29 may be extended out of end block 12 for directly engaging lever 36. Instead of pin 31 and slot 32, a rib may be arranged along driveshaft 16, and a slot may be arranged on the inside of cam 29 for engaging the rib, so that cam 29 is locked to driveshaft 16 for simultaneous rotation, but is free to slide along thereon. Therefore, the scope of the invention should be determined by the appended claims and their legal equivalents, not by the examples given.

I claim:

1. A rotary engine, comprising:

a toroidal chamber having an outer circumference and an inner circumference concentric about an axis;

an intake port extending into said toroidal chamber for introducing a pressurized gas;

an exhaust port extending from said toroidal chamber adjacent said intake port for venting an exhaust gas;

a gate extending across said toroidal chamber between said intake port and said exhaust port, an outer edge of said gate hinged about a pivot parallel to said axis and outside said outer circumference of said toroidal chamber, said gate being biased to a closed position across said toroidal chamber, said gate being arranged to open only in one direction toward said intake port, said pivot includes a tube with a longitudinal slot, and said gate includes a cylindrical head and a constricted neck, said cylindrical head sliding into said tube, said constricted neck sliding into said longitudinal slot; and a piston positioned within said toroidal chamber, a back of said piston for being acted upon by said pressurized gas, so that said piston is driven around said toroidal chamber in said direction, said gate being normally-closed for directing said pressurized gas to flow in said direction, a front of said piston pushing said exhaust gas out through said exhaust port, said gate pivoting open when struck by said piston to allow passage of said piston, said gate being biased closed after said piston has passed.

2. A rotary engine, comprising:

a toroidal chamber having an outer circumference and an inner circumference concentric about an axis;

an intake port extending into said toroidal chamber for introducing a pressurized gas;

an exhaust port extending from said toroidal chamber adjacent said intake port for venting an exhaust gas;

a gate extending across said toroidal chamber between said intake port and said exhaust port, an outer edge of said gate hinged about a pivot parallel to said axis and outside said outer circumference of said toroidal chamber, said gate being biased to a closed position across said toroidal chamber, said gate being arranged to open only in one direction toward said intake port; said pivot includes a tube with a longitudinal slot, and said gate includes a cylindrical head and a constricted neck, said cylindrical head sliding into said tube, said constricted neck sliding into said longitudinal slot;

a piston positioned within said toroidal chamber, a back of said piston for being acted upon by said pressurized gas, so that said piston is driven around said toroidal chamber in said direction, said gate being normally-closed for directing said pressurized gas to flow in said direction, a front of said piston pushing said exhaust gas out through said exhaust port, said gate pivoting open when struck by said piston to allow passage of said piston, said gate being biased closed after said piston has passed;

a driveshaft aligned with said axis of said toroidal chamber, said driveshaft connected to said piston for simultaneous rotation;

a tubular cam coaxially positioned on said driveshaft and arranged for simultaneous rotation; and an intake valve positioned over said intake port, said intake valve having a stem with a tip engaging said cam, said stem following a protruding cam surface of said cam as said cam rotates, so as to control opening and closing of said intake valve on said intake port.

* * * * *